US009840824B2

(12) United States Patent
Schmidt

(10) Patent No.: US 9,840,824 B2
(45) Date of Patent: Dec. 12, 2017

(54) MULTI-POSITION TOOL COUPLER

(71) Applicant: Stephen T Schmidt, Eatonville, WA (US)

(72) Inventor: Stephen T Schmidt, Eatonville, WA (US)

( * ) Notice: Subject to any disclaimer, the term of this patent is extended or adjusted under 35 U.S.C. 154(b) by 428 days.

(21) Appl. No.: 14/400,513

(22) PCT Filed: May 10, 2013

(86) PCT No.: PCT/US2013/040511

§ 371 (c)(1),
(2) Date: Nov. 11, 2014

(87) PCT Pub. No.: WO2013/173183

PCT Pub. Date: Nov. 21, 2013

(65) Prior Publication Data

US 2015/0139716 A1 May 21, 2015

Related U.S. Application Data

(60) Provisional application No. 61/646,266, filed on May 12, 2012.

(51) Int. Cl.

| | |
|---|---|
| ***E02F 3/36*** | (2006.01) |
| ***E02F 3/76*** | (2006.01) |
| ***E02F 3/96*** | (2006.01) |

(52) U.S. Cl.

CPC ..... *E02F 3/3609* (2013.01); *E02F 3/3686* (2013.01); *E02F 3/3695* (2013.01); *E02F 3/7627* (2013.01); *E02F 3/96* (2013.01); *E02F 3/3627* (2013.01); *E02F 3/3631* (2013.01); *Y10T 403/32163* (2015.01)

(58) Field of Classification Search

CPC ..... E02F 3/345; E02F 3/3609; E02F 3/3663; E02F 3/369; E02F 3/3695; E02F 3/3686; E02F 3/3677; E02F 3/32; E02F 3/325; E02F 3/627; E02F 3/96; E02F 3/7627; E02F 3/7609

See application file for complete search history.

(56) References Cited

U.S. PATENT DOCUMENTS

| | | | | | |
|---|---|---|---|---|---|
| 4,921,392 | A * | 5/1990 | Wagner | E02F 9/085 | 212/304 |
| 5,304,013 | A * | 4/1994 | Parsons | E01C 19/266 | 404/127 |
| 5,819,445 | A * | 10/1998 | LaBelle | E02F 3/3677 | 172/817 |
| 6,988,560 | B2 * | 1/2006 | Bay | A01B 59/042 | 172/272 |
| 7,624,520 | B2 * | 12/2009 | Gordon | E02F 3/7609 | 172/815 |

* cited by examiner

*Primary Examiner* — Daniel Wiley

(57) ABSTRACT

A coupling system for coupling a tool to be carried over the earth to a mobile tool carrier. The system includes an attachment base for attaching the coupling system to the mobile tool carrier and a center pivot assembly with a pivot that allows a tool support arm to swing to either side of the tool carrier where it extends to the side to allow the tool to be used to the side while the machine moves forward. The support arm includes a vertical hinge that divides the arm into two parts, allowing the arm to fold so the tool can be either in front of the machine or beside the machine. The tool may be connected to the support arm with a quick-coupler having hooks or with a permanent attachment.

14 Claims, 9 Drawing Sheets

MULTI-POSITION TOOL COUPLER

This application claims priority from U.S. provisional application 61/646,266 filed May 12, 2012 which is incorporated by reference, and from PCT/US2013/040511 Filed May 10, 2013, which claimed priority from the provisional and of which this application is a continuation.

BACKGROUND

Machines originally designed as front end loaders with tracks or wheels, whether having skid-steering wheels or turnable wheels, such as Bobcat brand machines, have been adapted to become general purpose mobile tool carriers that can receive a variety of controllable tool attachments to be attached to the front or back of the machine and controlled by an operator sitting in the operator's seat.

SUMMARY OF THE INVENTION

In addition to allowing an attached tool to be mounted directly off the front or back of a mobile tool carrier, the invented coupler allows attached tools to be moved either side of a tool carrying machine, allowing machines to go forward that in the past had to go backwards because the tool placed in front created spoils that when driving forward would force it on to those newly created spoils and would raise the machine off the surface datum of the road surface. For example, consider a road cold planer. It grinds up the road surface and so the machine must work backwards to keep it on the road surface datum.

Also, with prior art equipment, dusty and dirty work such as cold planing and sweeping is done in front of the machine, throwing up dirt and debris towards the cab and operator if the machine moves forward. Placing the tool to the side allows the material to pass to the side.

Grading to the side allows the machine to provide a finish grade while moving forward and without disturbing the finish grade created.

Placing an attachment to the side allows an operator to more effectively address his work and obstacles including utility structures. With prior art equipment, in many cases, the obstacles and work are under the machine.

Placing an attachment to the side adds the stability of an outrigger, allowing the use of tools on hillside work areas or unstable or sloped shoulders, particularly when a wheel that rides on the earth surface to control height of the tool is included.

In one aspect, the invention is a coupling system for coupling a tool to be carried over the earth to a mobile tool carrier supported vertically by the earth and having forward and reverse directions of travel. The system includes an attachment base adapted for attaching the coupling system to an attachment support structure on the mobile tool carrier and, fixed to the attachment base, a center pivot assembly with a pivot. A support arm, having a proximal end and a distal end, is pivotably attached at its proximal end to the pivot of the center pivot assembly, allowing the arm to pivot to at least a first horizontal position and a second horizontal position at 180 degrees from the first position. Affixed to the distal end of the support arm is a mirror image tool support adapted to allow coupling of a tool to the distal end of the support arm in either of two positions at 180 degrees from each other, one position adapted for the forward direction of travel and the other position adapted for the reverse direction of travel.

In a preferred embodiment, the support arm has a length greater than one half of the width of the mobile tool carrier such that, when the coupling system attachment base is mounted on a longitudinal end of the mobile tool carrier, the support arm protrudes beyond one side of the mobile tool carrier when in the first horizontal position and protrudes beyond the other side of the mobile tool carrier when in the second horizontal position.

Also in the preferred embodiment, the support arm includes a vertical hinge that divides the arm into two parts, an inner arm and an outer arm, and allows the inner arm and the outer arm to fold to be parallel to each other and allows the distal end of the support arm to be close to the proximal end of the support arm.

The coupling system may include a hydraulic actuator coupled to the inner arm and the outer arm that causes the outer arm to pivot about the hinge.

In a preferred embodiment, when the inner arm and the outer arm are folded parallel to each other and the distal end of the support arm is close to the proximal end of the support arm, a locking mechanism can secure the distal end of the support arm to the center pivot assembly. The locking mechanism may be a pin that is inserted into holes in the distal end of the support arm and in the coupling system attachment base.

In another aspect, the invention is an earth surface working tool to be carried over the earth mountable to a mobile tool carrier supported vertically by the earth and having forward and reverse directions of travel. This tool includes the elements of the above described aspect but the tool is permanently attached to the above described coupler assembly at the distal end of the support arm. In this aspect, the tool may include a tool height control wheel that rests on the earth to control height of the tool relative to the earth.

In another aspect, the invention is an earth surface working tool having a longitudinal direction of travel and an upright position with a quick attachment coupler with hooks for attaching the tool to a coupler system. The quick attachment coupler includes a base structure affixed to the tool, attached to the base structure, two plates that are parallel and aligned with each other and vertical when the tool is upright, the plates being between 13 and 17 inches apart at their nearest surfaces and parallel to the direction of travel of the tool. Each plate has an edge attached to the base structure, the remaining edges having nothing attached so they are available for attachment. The remaining edge of each plate forms a hook shape with a hook opening directed downward when the tool is upright, each hook forming an inner hook diameter between 1 and 2 inches, the diameter having a center, and the hook being in the upper half of the remaining edge when the tool is upright, the two hooks being parallel and aligned with each other. Each plate also has, when the tool is upright, a hole having a center below the hook, the center of the hole being between 11 and 16 inches from the center of the diameter of the hook, the two holes being parallel and aligned with each other.

The earth surface working tool may be any one of a trencher, a cold planer, a grading blade, an asphalt strike blade, a compaction wheel, a compaction roller, a vibratory roller, an earth plow, a vibratory earth plow, a snow plow, a broom sweep, a power rake, a vibratory plate compactor, a backfill blade, a siltfence installer, a wire backed siltfence installer, a fencing installer, a drop hammer, a post pounder, a curb and gutter extruder, a plastic pipe reel, a trench bedding box, a trench fabric dispenser, a concrete horizontal drill, an asphalt paver, a post installer, a concrete/asphalt saw, a manhole cutter, a concrete pulverizer, a snowblower, a concrete pulverizer, a rotary saw, a wheel saw, a cable puller, a cable plow, or a cable reel.

The drawings and the following detailed description are illustrative of the invention but not restrictive of the invention which may be modified in various ways without departing from the essence of the invention.

DETAILED DESCRIPTION

Coupler System Parts List

Figure 1:
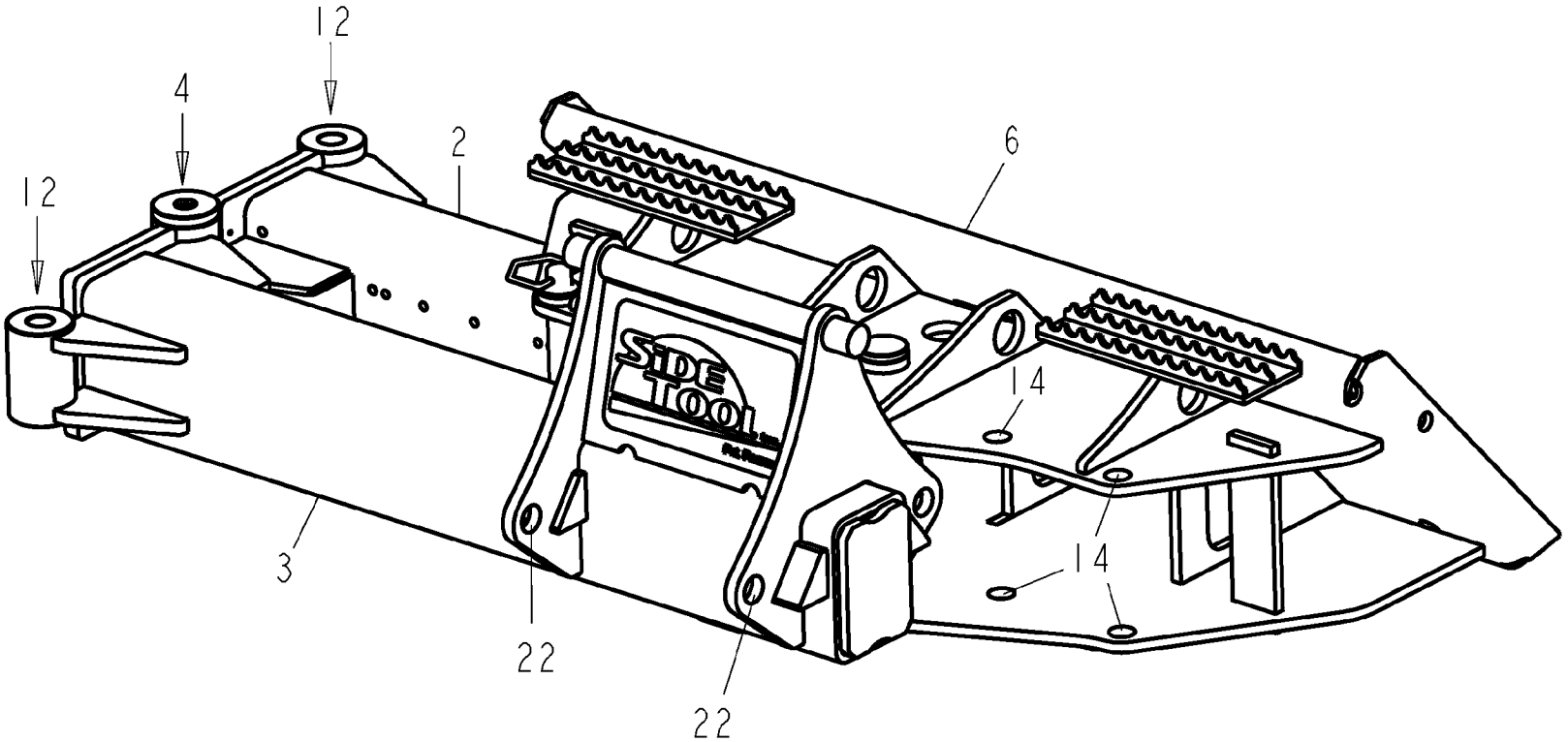
FIG. 1 shows the coupling system in a folded position.
Figure 2:
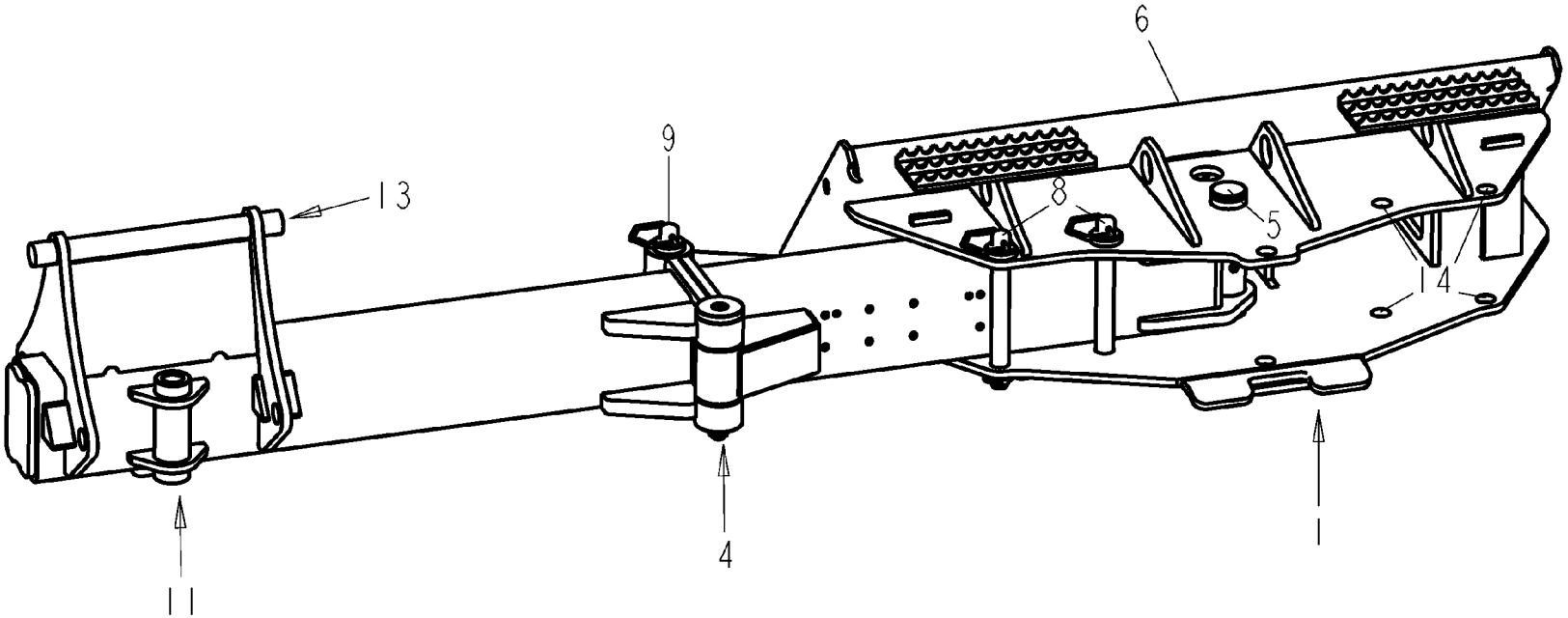
FIG. 2 shows the coupling system in an extended position.
Figure 3:
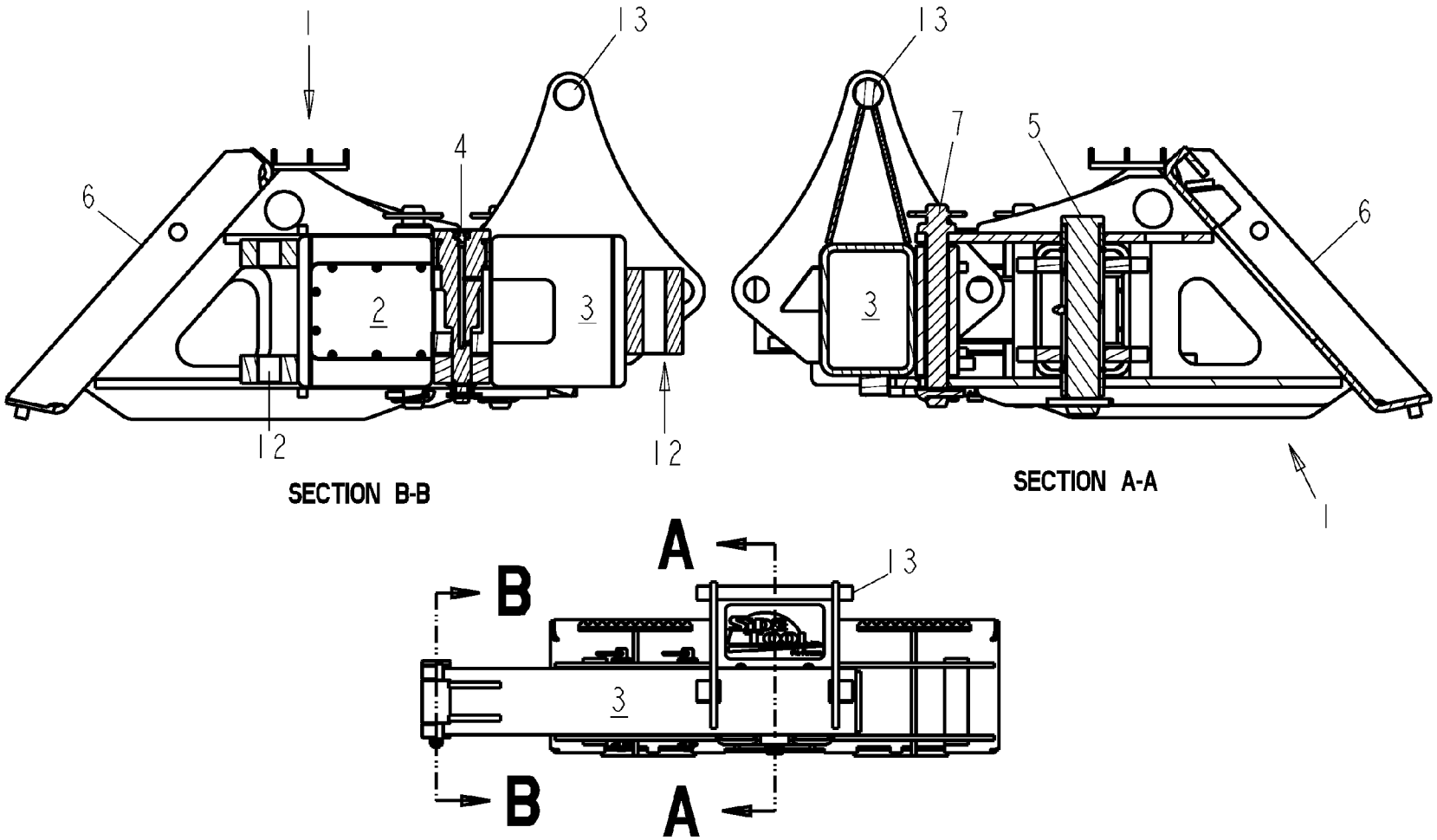
FIG. 3 shows two vertical cross sections of the coupling system in a folded position.
Figure 4:
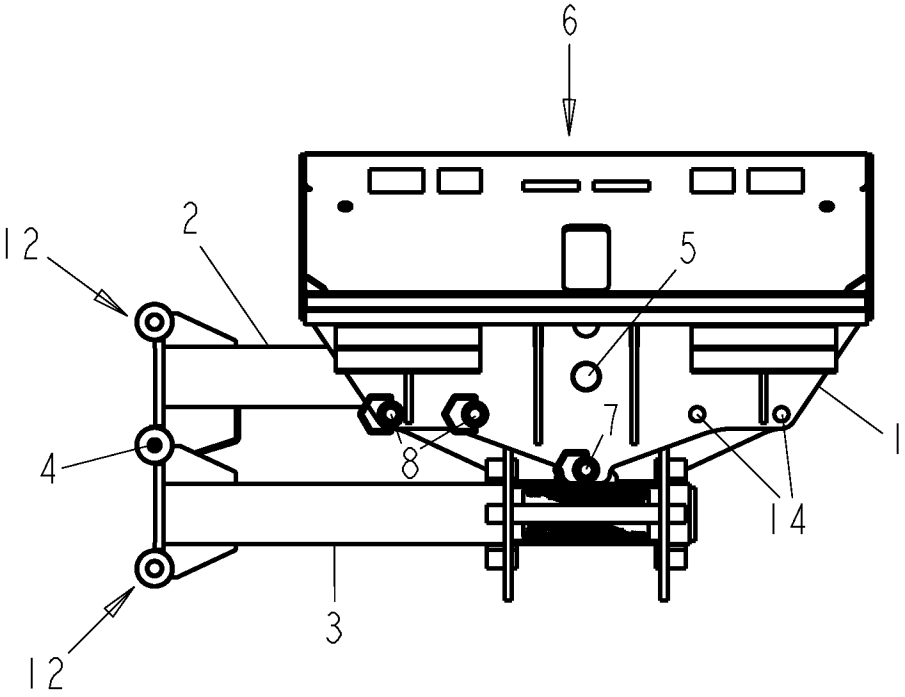
FIG. 4 shows a top view of the coupling system in a folded position.

1. Coupler center pivot assembly
2. Inner support arm
3. Outer support arm
4. Arm Hinge
5. Main pivot pin
6. Universal coupling system attachment base
7. Center position lock pin
8. Side position lock pins
9. Extended position hinge lock pin
10. Center position lock holes in center pivot assembly
11. Center position lock hole at distal end of support arm
12. Arm hinge lock holes
13. Tool support bar
14. Side position lock holes
15. Mobile tool carrier
16. Trencher attachment
17. Backfill blade attachment
18. Compaction wheel attachment
19. Quick coupler parallel plates with hooks and holes
20. Hooks in the quick coupler parallel plates
21. Holes the quick coupler parallel plates
22. Holes in the tool support As shown in FIGS. 1-4, in one embodiment, the coupler system includes a universal coupling system attachment base 6 which holds a center pivot assembly 1 which holds pivot 5 which holds the inner support arm 2 which holds the outer support arm 3. The pivot 5 is preferably vertical as shown but it may be configured to be horizontal.

The center pivot assembly 1 includes side position lock holes 14 which allow the support arm to be locked in position to either side of the tool carrier by inserting lock pins 8. The center pivot assembly 1 also includes center position lock holes 10 which allow the outer support arm 3 to be locked to the attachment base.

The outer support arm 3 is coupled to the inner support arm 2 with a vertical hinge 4. The hinge may be locked in an extended position by inserting locking pin 9 into arm hinge locking holes 12.

A center position lock hole 11 for receiving center position locking pin 7 is located at the distal end of the outer support arm, along with a mirror-image quick attachment tool support structure in the form of a bar 13 and means for securing the tool to the outer support arm such as holes 22. The tool support is adapted to allow coupling of a tool to the distal end of the support arm in either of two positions at 180 degrees from each other, one position adapted for the forward direction of travel and the other position adapted for the reverse direction of travel.

The arm may include a hydraulic actuator coupled to the inner arm and the outer arm that causes the outer arm to pivot about the hinge.

The coupler system may be incorporated into an earth surface working tool that includes the above described elements but the tool is permanently attached to coupler system at the distal end of the support arm.

The system preferably includes quick coupler components for easily adding or removing a tool. The components include a support bar 13. To be strong enough made from steel and not excessively heavy, the bar should be between 1 and 2 inches in diameter. To give adequate stability to the tool and not be excessively heavy, the bar should be between 15 and 20 inches in length with stops (preferably formed by parallel plates that hold the bar) between 13 and 17 inches apart. Below the bar should be holes (preferably formed in the parallel plates that hold the bar) to which a quick coupler component attached to the tool can be affixed with bolts or pins. To give the holes adequate leverage and avoid excessive weight, the centers of the holes should be between 11 and 16 inches from the center of the bar.

Figure 5:
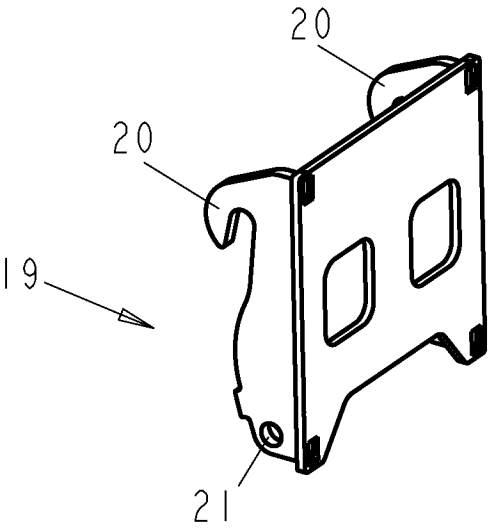
FIG. 5 shows a quick coupler for a tool to hook on the tool support.
Figure 6:
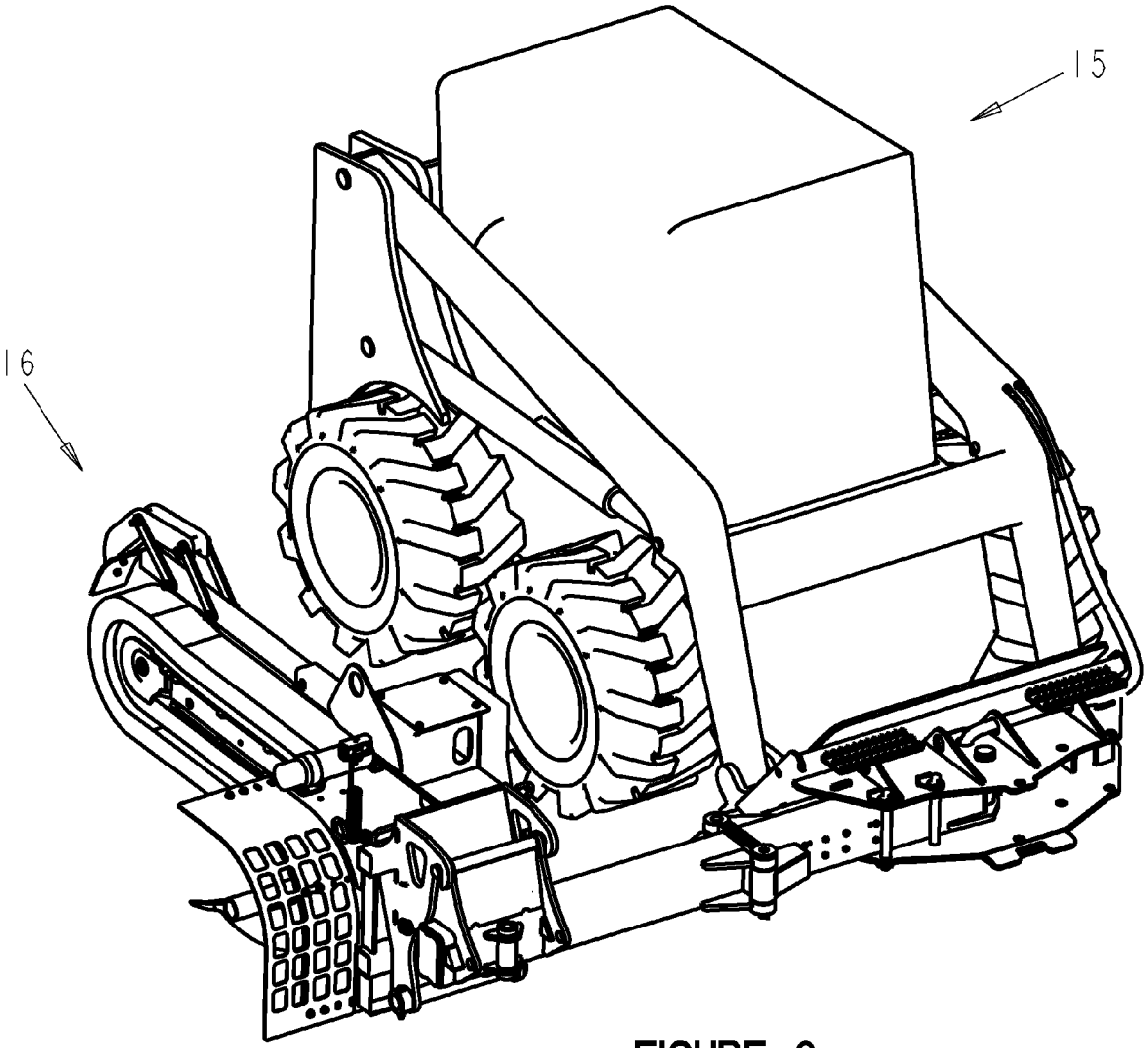
FIG. 6 shows a trench digging tool mounted on a tool carrier.
Figure 7:
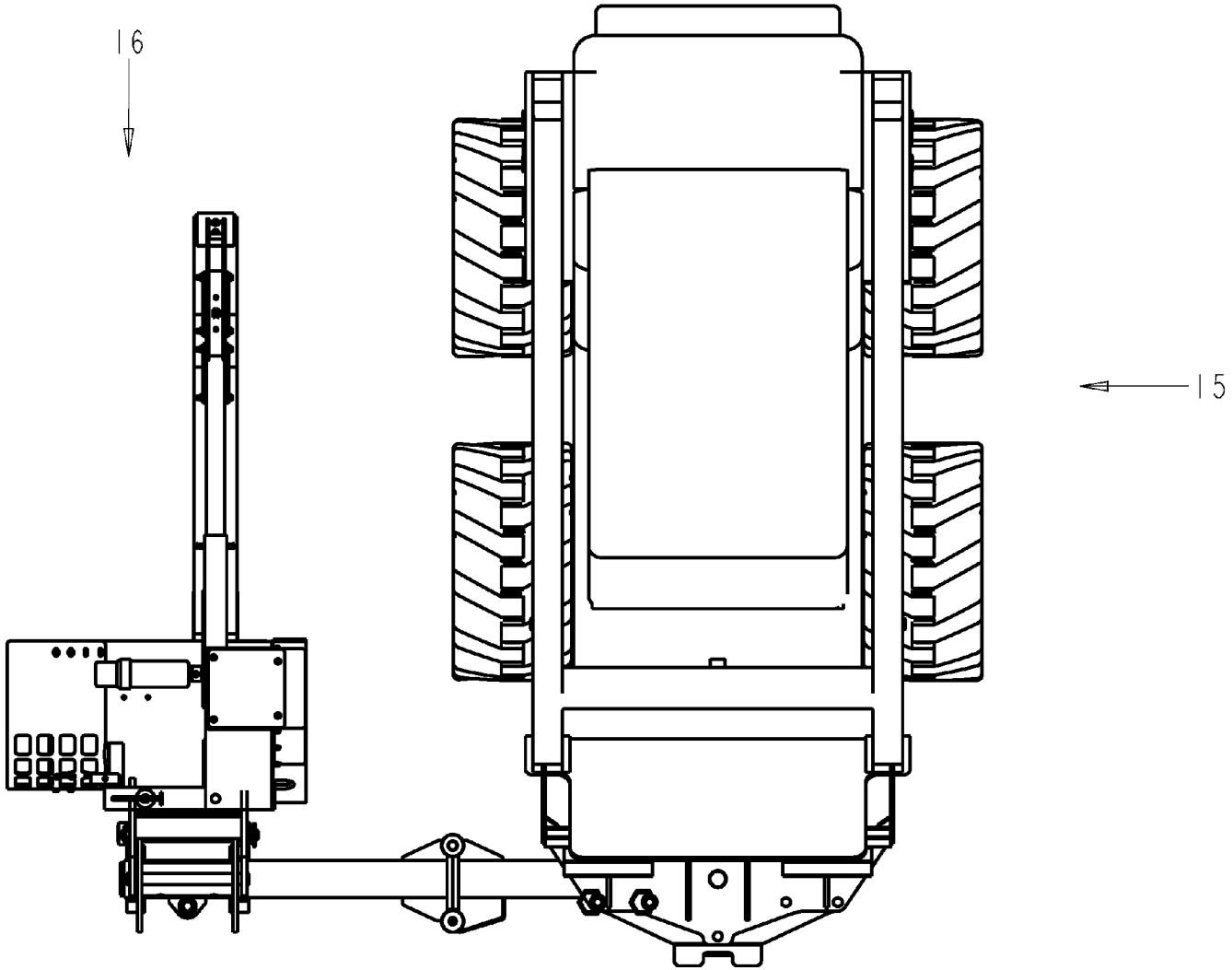
FIG. 7 shows a top view of the trench digging tool mounted on a tool carrier.
Figure 8:
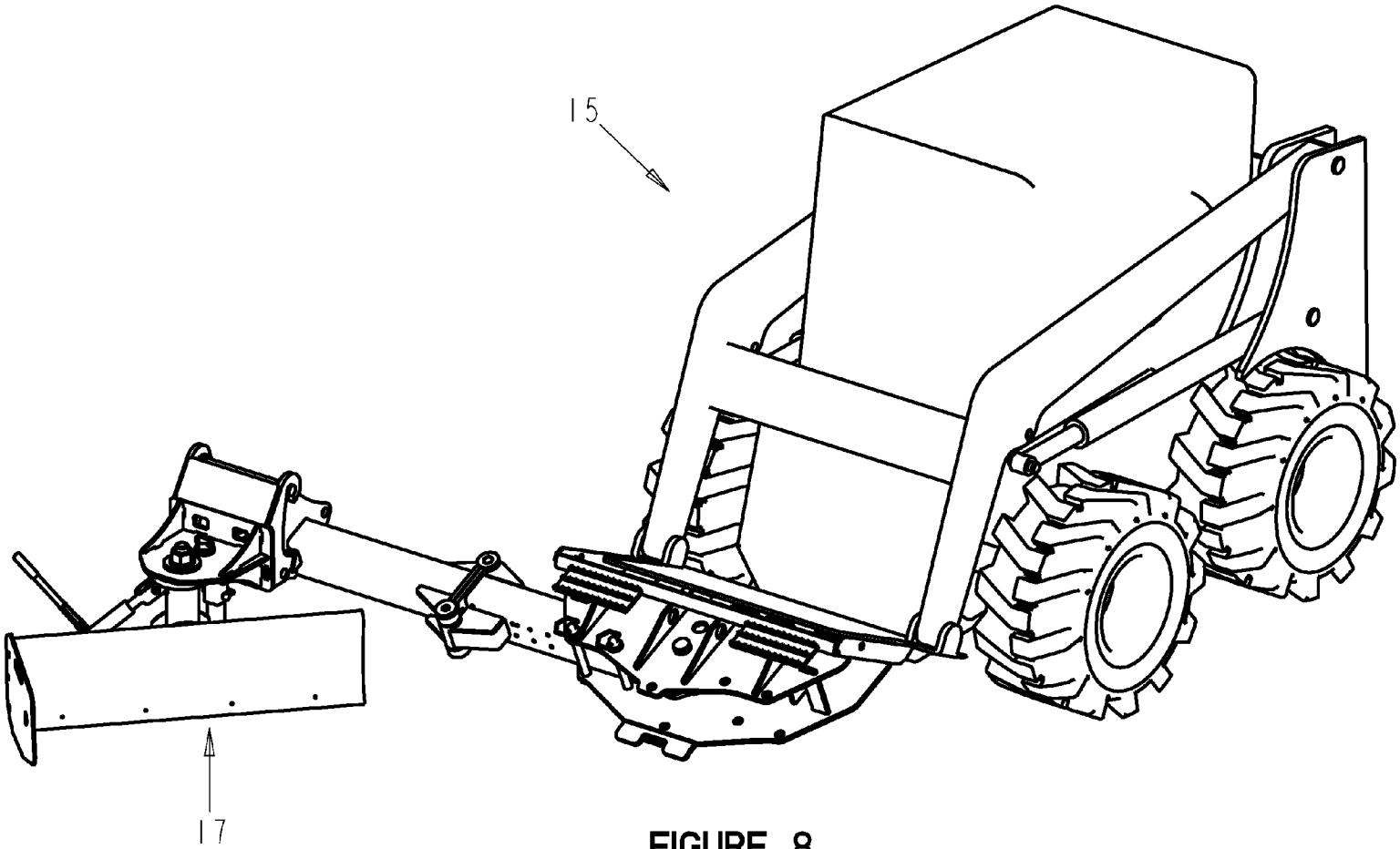
FIG. 8 shows a grading tool (backfill blade) mounted on a tool carrier.
Figure 9:
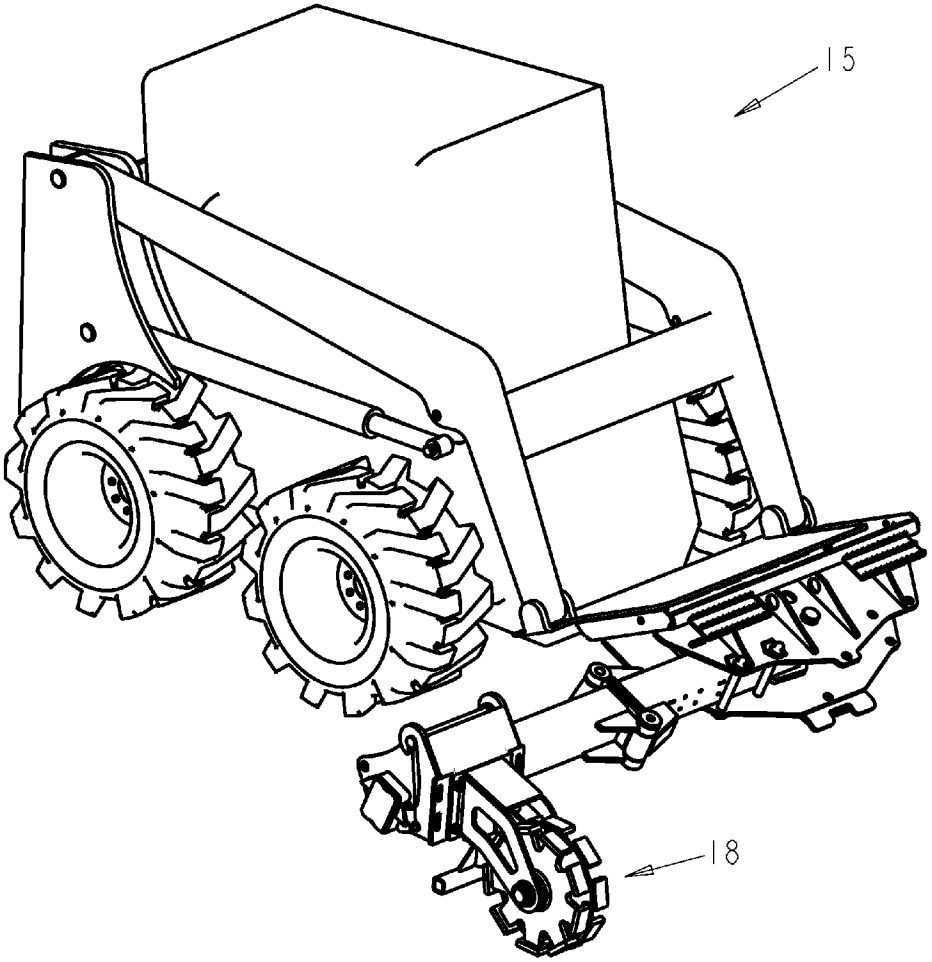
FIG. 9 shows a compaction wheel mounted on a tool carrier.

The tool should have attached to it hooks and holes for attachment to the tool support structure. It is preferable to make the hooks and holes in two parallel and aligned cut steel plates as shown in FIG. 5. The two plates are parallel and aligned with each other and vertical when the tool is upright. To give adequate stability to the tool and not be excessively heavy, the plates are between 14 and 18 inches apart at their nearest surfaces and parallel to the direction of travel of the tool. Each plate has an edge attached to the base structure, the remaining edges having nothing attached so they are available for attachment. The remaining edge of each plate forms a hook shape with a hook opening directed downward when the tool is upright, each hook forming an inner hook diameter between 1 and 2 inches to fit the support bar 13. To give stability and strength when made from plain steel and not too heavy, the hooks should be in the upper half of the remaining edge when the tool is upright. Each plate also has, when the tool is upright, a hole having a center below the hook. To give stability and strength when made from plain steel and not too heavy, the center of the holes should be between 11 and 16 inches from the center of the diameter of the hook, the two holes being parallel and aligned with each other.

An earth surface working tool may include a tool height control wheel that rests on the earth to control height of the tool relative to the earth. The earth surface working tool may be any one of a trencher, a cold planer, a grading blade, an asphalt strike blade, a compaction wheel, a compaction roller, a vibratory roller, an earth plow, a vibratory earth plow, a snow plow, a broom sweep, a power rake, a vibratory plate compactor, a backfill blade, a siltfence installer, a wire backed siltfence installer, a fencing installer, a drop hammer, a post pounder, a curb and gutter extruder, a plastic pipe reel, a trench bedding box, a trench fabric dispenser, a concrete horizontal drill, an asphalt paver, a post installer, a concrete/asphalt saw, a manhole cutter, a concrete pulverizer, a snowblower, a concrete pulverizer, a rotary saw, a wheel saw, a cable puller, a cable plow, or a cable reel.

Having illustrated and described my invention in a preferred embodiment, it will be apparent to those skilled in the art that the invention can be modified in arrangement and detail without departing from the essence of the invention. I claim all modifications coming within the spirit and scope of the accompanying claims.

The invention claimed is:

1. A coupling system for coupling a tool to be carried over the earth to a mobile tool carrier supported vertically by the earth and having forward and reverse directions of travel, comprising:

a. a coupling system attachment base adapted for attaching the coupling system to an attachment support structure on the mobile tool carrier;

b. fixed to the attachment base, a center pivot assembly with a pivot;

c. a support arm, having a proximal end and a distal end, pivotably attached at its proximal end to the pivot of the center pivot assembly, capable of pivoting to at least a first horizontal position and a second horizontal position at 180 degrees from the first position;

d. affixed to the distal end of the support arm, a tool support adapted to allow coupling of a tool to the distal end of the support arm; and e. within the support arm, a vertical hinge that divides the arm into two parts, an inner arm and an outer arm, and allows the inner arm and the outer arm to fold to be parallel to each other and allows the distal end of the support arm to be close to the proximal end of the support arm.

2. The coupling system of claim 1 where the mobile tool carrier has a width between two sides and the support arm has a length greater than one half of the width between the two sides such that, when the coupling system attachment base is mounted on a longitudinal end of the mobile tool carrier, the support arm protrudes beyond one side when in the first horizontal position and protrudes beyond the second side when in the second horizontal position.

3. The coupling system of claim 1 further comprising a hydraulic actuator coupled to the inner arm and the outer arm that causes the outer arm to pivot about the hinge.

4. The coupling system of claim 1 wherein, when the inner arm and the outer arm are folded parallel to each other and the distal end of the support arm is close to the proximal end of the support arm, a locking mechanism can secure the distal end of the support arm to the center pivot assembly.

5. The coupling system of claim 4 where the locking mechanism is a pin that is inserted into holes in the distal end of the support arm and in the coupling system attachment base.

6. The coupling system of claim 1 wherein the tool support comprises a mirror image tool support adapted to allow coupling of a tool to the distal end of the support arm in either of two positions at 180 degrees from each other, one position adapted for the forward direction of travel and the other position adapted for the reverse direction of travel.

7. An earth surface working tool to be carried over the earth mounted to a mobile tool carrier supported vertically by the earth and having forward and reverse directions of travel, comprising:

a. a coupling attachment base adapted for attaching the tool to an attachment support structure on the mobile tool carrier;

b. fixed to the attachment base, a center pivot assembly with a pivot;

c. a support arm, having a proximal end and a distal end, pivotably attached at its proximal end to the pivot of the center pivot assembly, capable of pivoting horizontally to at least a first position and a second position at 180 degrees from the first position; and d. affixed to the distal end of the support arm, an earth surface working tool; and e. within the support arm, a vertical hinge dividing the support arm into an inner arm and an outer arm which allows the two parts of the arm to fold to be parallel to each other and allows the distal end of the support arm to be close to the proximal end of the support arm.

8. The tool of claim 7 further comprising, at the distal end of the support arm, an adjustment mechanism that allows the tool to be coupled to the support arm in either of two positions at 180 degrees from each other, one position adapted for the forward direction of travel and the other position adapted for the reverse direction of travel.

9. The tool of claim 7 where the mobile tool carrier has a width between two sides and the support arm has a length greater than one half of the width between the two sides such that, when the coupling system attachment base is mounted on a longitudinal end of the mobile tool carrier, the support arm protrudes beyond one side when in the first position and protrudes beyond the second side when in the second position.

10. The tool of claim 7 further comprising a hydraulic actuator coupled to the inner arm and the outer arm that causes the outer arm to pivot about the hinge.

11. The tool of claim 7 wherein, when the inner arm and the outer arm are folded parallel to each other and the distal end of the support arm is close to the proximal end of the support arm, a locking mechanism can secure the distal end of the support arm to the center pivot assembly.

12. The tool of claim 11 where the locking mechanism is a pin that is inserted into holes in the distal end of the support arm and in the coupling attachment base.

13. The tool of claim 7 further comprising a tool height control wheel that rests on the earth to control height of the tool relative to the earth.

14. The tool of claim 7 where the earth surface working tool is one of a trencher, a cold planer, a grading blade, an asphalt strike blade, a compaction wheel, a compaction roller, a vibratory roller, an earth plow, a vibratory earth plow, a snow plow, a broom sweep, a power rake, a vibratory plate compactor, a backfill blade, a siltfence installer, a wire backed siltfence installer, a fencing installer, a drop hammer, a post pounder, a curb and gutter extruder, a plastic pipe reel, a trench bedding box, a trench fabric dispenser, a concrete horizontal drill, an asphalt paver, a post installer, a concrete/asphalt saw, a manhole cutter, a concrete pulverizer, a snowblower, a concrete pulverizer, a rotary saw, a wheel saw, a cable puller, a cable plow, or a cable reel.

* * * * *